US006190813B1

(12) United States Patent
Tanaka et al.

(10) Patent No.: US 6,190,813 B1
(45) Date of Patent: Feb. 20, 2001

(54) IMAGING METHOD AND IMAGING DEVICE

(75) Inventors: Yuji Tanaka; Hirofumi Kawaguchi, both of Osaka (JP)

(73) Assignee: Kyocera Mita Corporation, Osaka (JP)

( * ) Notice: Under 35 U.S.C. 154(b), the term of this patent shall be extended for 0 days.

(21) Appl. No.: 09/506,393

(22) Filed: Feb. 18, 2000

(30) Foreign Application Priority Data

Feb. 22, 1999 (JP) ..... 11-043159

(51) Int. Cl.[7] ..... G03G 13/08; G03G 15/08
(52) U.S. Cl. ..... 430/100; 430/126; 399/315
(58) Field of Search ..... 430/100, 126; 399/315

(56) References Cited

U.S. PATENT DOCUMENTS 4,914,737 * 4/1990 Amemiya et al. ..... 399/315
5,035,973 * 7/1991 Kaga ..... 430/126
5,162,180 * 11/1992 Leenders et al. ..... 430/100
5,504,559 * 4/1996 Ojima et al. ..... 430/126
5,523,834 * 6/1996 Ito ..... 399/315
5,526,106 * 6/1996 Katsumi et al. ..... 399/315
5,589,922 * 12/1996 Amemiya et al. ..... 399/315
5,608,506 * 3/1997 Omoto ..... 399/315
5,614,343 * 3/1997 Nozomi et al. ..... 430/100

* cited by examiner

*Primary Examiner*—Roland Martin
(74) *Attorney, Agent, or Firm*—Shinjyu Intellectual Property Firm

(57) ABSTRACT

With the object of providing an imaging method that eliminates the occurrence of transfer ghosts, saves space and lowers costs, and by which image density irregularities do not arise, an imaging method utilized in a reverse-transfer system is disclosed. The reverse-transfer system is provided with, in order going round a photosensitive conductor 1, at least a main-charging stage 2, an exposure stage 3, a reverse-developing stage 4, a transfer stage 5, a separation stage 6 and a charge-stripping stage 7. The separation stage 6 applies a separation shift-bias voltage to the photosensitive conductor 1 surface. The separation shift-bias voltage is 1 kV or more, and is of the same polarity as that of the main-charging voltage that the main-charging stage 2 applies to the photosensitive conductor 1 surface. Making the separation shift-bias voltage 1 kV or more prevents transfer ghosts, and obtains images with a satisfactory absence of image density irregularities.

11 Claims, 1 Drawing Sheet

IMAGING METHOD AND IMAGING DEVICE

BACKGROUND OF THE INVENTION

1. Technical Field

The present invention is an imaging method and imaging device that is applied to copiers, laser printers, and facsimiles. In particular, in imaging methods and devices that utilize reverse development, the present invention, by making the separation shift-bias voltage polarity opposite to the transferring voltage, and lkV or more, is so as to prevent image density irregularities due to the influences of transfer ghosts.

2. Description of Related Art

In imaging methods utilizing reverse development, the surface of a photosensitive conductor at first takes a main charge, and an electrostatic latent image corresponding to an original document image by exposing the image portion of the document is formed on the surface of the photosensitive conductor. Next, toner charged at the same polarity as the main charge develops the exposure portions of the electrostatic latent image, to which a developing bias voltage has been applied. Then further, the formed toner image is transferred to a transfer medium utilizing transferring voltage of reverse polarity to the main charge, after which the image is fixed onto the transfer medium. Therein, in the transfer process, the transfer medium, such as paper, contacts the photosensitive conductor and is electrostatically adhered to the photosensitive conductor surface. In a separation process, applying a voltage through the back side of the transfer medium electrostatically neutralizes, strips the charge of, and separates the adhered transfer medium from the photosensitive conductor surface. With such separation processes, methods that apply AC voltage to the transfer medium have been conventionally utilized.

Imaging methods like this are widely used in such imaging devices as digital and analog photocopiers, printers, or ordinary-paper facsimile machines. Therein, imaging methods by reverse development, i.e., imaging methods that develop using toner of the same polarity as the main-charging voltage applied to the photosensitive conductor, in particular are widely used as digital-imaging methods.

FIG. 1 schematically depicts an example of an imaging device that uses reverse development; 1 is a photosensitive conductor that rotates unidirectionally at constant speed, and the photosensitive conductor 1 is a drum base-form on the surface of which a photosensitive layer is formed. Surrounding the photosensitive conductor 1, in its advancing direction—in other words, along its rotational direction—a main-charging unit 2, an exposure unit 3, a reverse-developing unit 4, a transfer unit 5, a separation unit 6 and a charge-stripping device 7 are provided, in that order.

In imaging methods that use reverse development, the transferring voltage applied to the surface of the photosensitive conductor 1 by the transfer unit 5 ordinarily is not applied directly but is applied through a transfer medium 8, and is not applied when the transfer medium 8 does not pass through the transfer unit 5. Nevertheless, on/off timing the transferring voltage is extremely difficult, and transferring voltage gets applied directly to the photosensitive conductor 1, on those portions just before the leading edge and just after the trailing edge of the transfer medium 8. In other words, because the transferring voltage begins to be applied just before the leading edge of the transfer medium 8 reaches the transfer unit 5, and further, the transferring voltage continues to be applied even when the trailing edge of the transfer medium 8 passes the transfer unit 5, at these timings transferring voltage is directly applied to the photosensitive conductor 1.

Further, in reverse development systems the transferring voltage applied to the surface of the photosensitive conductor 1 by the transfer unit 5 is of opposite polarity to that of the main-charging voltage applied with the main-charging unit 2. Therefore, when a transferring voltage greater than the superficial electric potential on the photosensitive conductor 1 is applied, the polarity of those portions on the photosensitive conductor 1 to which voltage is applied directly (below, noted as "direct-applied portions") becomes opposite to that of the superficial electric potential on the photosensitive conductor 1 when given its main charge.

At this point, the photosensitive characteristics of the photosensitive conductor 1 will be explained. As a photosensitive conductor 1, there are, on a conductive base form, the single-layer type, in which electric charge conveying agents, electric charge generating agents, and a binding synthetic polymer are mixed and formed into one layer, and the laminated type, in which a charge conveying layer and a charge generating layer are laminated.

Single-layer type photosensitive bodies, because they contain a positive-hole conveying agent and an electron conveying agent as electric charge conveying agents, have optical sensitivity at positive/negative, dual polarity. Nevertheless, because there is a difference in charge (positive-hole or electron) travel speed between the positive-hole conveying agent and electron conveying agent, generally optical sensitivity during opposite-polarity charging will be remarkably greater than when charged to either polarity. In reverse development systems, to secure satisfactory developing conditions in the reverse-developing unit 4, ordinarily main-charging voltage of polarity for the greater optical sensitivity, and transferring voltage of polarity for the lesser optical sensitivity are utilized.

With laminated type photosensitive bodies on the other hand, whether they are either positive or negative charging is determined by the sequence in which the charge-generating layer and charge-conveying layer are formed, and by the type of charge-conveying agent (electron-conveying agent or positive-hole conveying agent) used for the charge-conveying layer. Herein, there is none of the aforementioned optical sensitivity with respect to charging type and opposite polarity, and stripping charge on the surface of the photosensitive conductor to get rid of dark attenuation is not possible. In reverse-developing systems, main-charging voltages of polarity having optical sensitivity, as well as transferring voltages of polarity not having optical sensitivity are utilized.

As a result, in using either a single-layer or a laminated photosensitive conductor, the superficial electric potential of the direct-applied portions on the photosensitive conductor 1 just after transfer, at polarity opposite to that of the main charge, takes on the polarity of lesser optical sensitivity, or of no optical sensitivity.

In the separation unit 6, a separation voltage is applied to the photosensitive conductor 1 and to the transfer medium 8 after having passed through the transfer unit 5. Ordinarily, because the separation voltage is AC, dual-polarity voltage is applied, which does not result in neutralization of the electric potential of the direct-applied portions on the photosensitive conductor 1. Further, although a shift bias voltage of the same polarity as the main-charging voltage can be superimposed on the separation voltage, wherein the shift bias voltage is lower than the superficial electric potential of the direct-applied portions, the direct-applied portions are as such still of polarity opposite to that of the main-charging voltage.

This makes it all the more unlikely that the superficial electric potential of polarity opposite to that of the remaining main-charging voltage will be removed sufficiently with the charge-stripping beam that is irradiated onto the surface of the photosensitive conductor 1 in the charge-stripping device 7 after the separation unit 6. Transfer ghosts therefore arise, caused by the opposite-polarity electric charge remaining on the photosensitive conductor 1 surface, or remaining as spatial charge in the photosensitive conductor 1 interior.

Thus under the circumstances, when the photosensitive conductor 1 has received a succeeding main charge through the main-charging unit 2, the opposite-polarity charge remaining after irradiation by the charge-stripping beam negates the charge from the main-charging, which lowers the superficial electric potential on the photosensitive conductor 1. Herein, in reverse development, the portions that are exposed, by which the superficial electric potential is lowered, are developed with toner. When the portions in which the superficial electric potential is lowered by a transfer ghost as described earlier are exposed, however, their superficial electric potential is lowered further, generating a difference in electric potential between them and the other exposed portions, such that they are developed with toner in excess of normal. Density irregularities, wherein the image density in these portions is thickened, therefore arise. The density irregularities are especially pronounced in halftone images and images that are halftone reproductions.

Making the transfer voltage smaller than the superficial electric potential on the photosensitive conductor 1 would do away with the problem of transfer ghosts, but in that case, the toner image would not be transferred to the transfer medium. This is because when the transfer voltage is applied through the transfer medium 8, the transfer voltage is shielded by the transfer medium 8, which remarkably diminishes the applied voltage that acts on the photosensitive conductor 1 surface.

Another solution means would be the method of suppressing the voltage applied directly to the photosensitive conductor by increasing the transfer voltage in stages at the start of transfer voltage application. Nevertheless, with this method, the other stages of the transfer voltage have to be controlled, which therefore not only complicates the apparatus but also raises its cost.

Still another means would be the method of enlarging the width of the main-charging device and meanwhile increasing its output. This is designed, in other words, to uniform the main charge by applying the large main-charging voltage to the photosensitive conductor 1 surface over a longer term. Nevertheless, with this means the largeness of the main-charging device ends up enlarging the apparatus overall. In addition, increasing the output of the main-charging device generates large amounts of ozone and nitrogen-oxide discharge products, leading to the problem that this deteriorates the photosensitive conductor surface.

SUMMARY OF THE INVENTION

An object of the present invention to provide a means of imaging that solves the foregoing the problems, is space-saving, low-cost, and does not give rise to image density irregularities.

An imaging method that utilizes a reverse-development system provided with at least a main-charging stage 2, an exposure stage 3, a reverse development stage 4, a transfer stage 5, a separation stage 6 and a charge-stripping stage 7 in order going round the photosensitive conductor 1, the imaging method of the present invention is characterized in that the separation stage 6 applies a separation shift-bias voltage to the photosensitive conductor 1 surface, and in that the separation shift-bias voltage is of the same polarity as that of the main-charging voltage that the main-charging stage 2 applies to the photosensitive conductor 1 surface, and is 1 kV or more.

The foregoing and other objects, features, aspects and advantages of the present invention will become more apparent from the following detailed description in conjunction with the accompanying drawing.

DETAILED DESCRIPTION OF THE PREFERRED EMBODIMENTS

Figure 1:
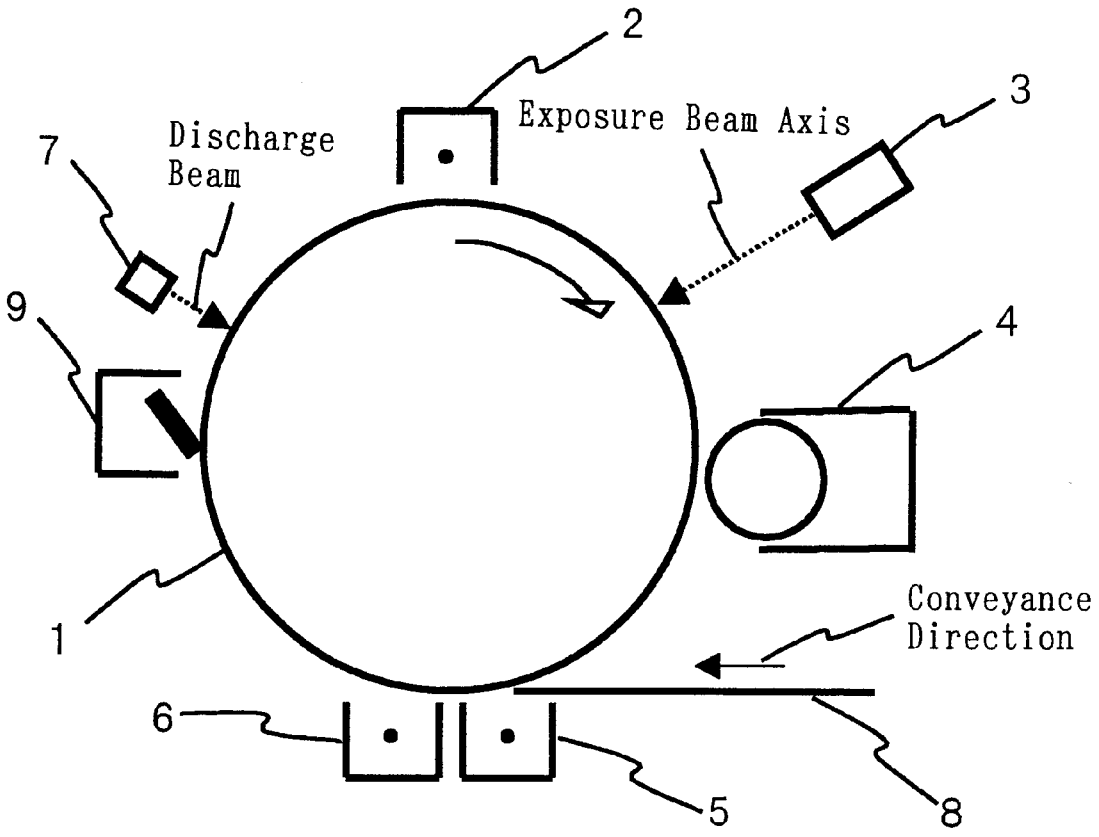
FIG. 1 is an explanatory diagram illustrating the arrangement of process stages for an imaging method of the present invention.

The following describes in detail an imaging method of the present invention.

Initially, a main-charging voltage is applied to the photosensitive conductor 1 in the main-charging stage 2. In general, the superficial electric potential on the photosensitive conductor 1 therein is set to be 300–1000 V.

Subsequently, in the exposure stage 3, an electrostatic latent image is formed on the photosensitive conductor 1 surface in correspondence with an original image by exposing the image portions of an original document. Afterwards, in the reverse-development stage 4, toner that is charged at the same polarity as that of the main charge develops the exposed portions of the electrostatic latent image, to with a developing bias voltage has been applied.

Following the reverse-development stage 4, in the transfer stage 5, the toner image formed on photosensitive conductor 1 is electrostatically transferred to the face of the transfer medium 8 by applying a transfer voltage of polarity opposite to that of the main charge through the back surface of the transfer medium 8.

As described earlier, the transfer stage 6 applies transfer voltage directly to the photosensitive conductor 1 in the portions just before the leading end and just after the trailing end of the transfer medium 8. In reverse-development systems, the transfer voltage polarity is opposite to that of the main-charging voltage, and is from several hundred to several thousand volts. Consequently, the polarity of the superficial electric potential on the photosensitive conductor 1 in the direct-applied portions to which transfer voltage is applied directly inverts, becoming opposite in polarity to that of the main-charging voltage. Therein, the superficial electric potential of the direct-applied portions on the photosensitive conductor 1 is in the neighborhood of several hundred V to 1 kV.

Following transfer voltage application, in the separation stage 5 a separation voltage is applied to the direct-applied portions. the separation voltage therein is of the same polarity as that of the main-charging voltage (opposite polarity to that of the transfer voltage) and is a 1 kV or more shift-bias voltage (noted as "separation shift-bias voltage" below) superimposed on an AC voltage.

Because the separation shift-bias voltage, in the manner described above, is of the same polarity as that of the main-charging voltage, it acts in a direction that negates the superficial polarity of the photosensitive conductor 1 in the direct-applied portions having superficial electric potential of opposite polarity to that of the main-charging voltage. Herein, the separation shift-bias voltage is 1 kV or more, and since its absolute value is greater than the superficial electric potential of the direct-applied portions, the polarity of the direct-applied portions changes to be the same as that of the separation shift-bias voltage, i.e., the main-charging voltage.

Further, in the portion of the photosensitive conductor 1 surface apart from the direct-applied portions (hereinafter noted as "indirect-applied portion"), since the transfer medium 8 intervenes between the photosensitive conductor 1 and the transfer stage 5, transfer voltage acting on the photosensitive conductor 1 is remarkably diminished. Accordingly, the polarity does not invert in the indirect-applied portions, which stay the same polarity as that of the main-charging voltage.

Thus by the foregoing, due to the fact that the separation shift-bias voltage is 1 kV or more, the superficial electric potential on the entire surface of the photosensitive conductor 1 is of the same polarity as that of the main-charging voltage, i.e., the polarity is that of the greater optical sensitivity, which enables optical charge-stripping in the charge-stripping stage 7, and eliminates the transfer ghost problem.

A separation shift-bias voltage especially from 1 kV to 1.6 kV will suppress the phenomenon of toner transferred onto the transfer medium 8 going back onto the photosensitive conductor 1. This is also desirable because the separation shift-bias voltage does not exert influence on the application of the transfer voltage in the vicinity of the transfer stage 5 and the separation stage 6, and satisfactory transfer conditions are gained.

EMBODIMENT OF THE PRESENT INVENTION

FIG. 1 schematically illustrates an example of a configuration for an imaging method embodied in the present invention:

1 is a photosensitive conductor that rotates unidirectionally at constant speed, and surrounding the photosensitive conductor 1, in its advancing direction—in other words, along its rotational direction—a main-charging unit 2 for executing a main-charging stage; an exposure unit 3 for executing an exposure stage; a reverse-developing unit 4 for executing a reverse-developing stage; a transfer unit 5 for executing a transfer stage; a separation unit 6 for executing a separation stage; and a charge-stripping device 7 for executing a charge-stripping stage are provided, in that order.

As for the photosensitive conductor 1, a photosensitive layer made from a photosensitive material such as amorphous silicon is formed on the surface of the drum base-form, an organic photosensitive conductor. The photosensitive layer may be the single-layer type made from one layer in which a charge-conveying agent, a charge-generating agent, and a binding resin are mixed, or the laminated type, in which a charge-conveying layer and a charge-generating layer are laminated. For the photosensitive conductor 1 in the present invention, either the single-layer type or the laminated type is applicable, but from the viewpoints of being able to employ either positive- or negative-type charging, of structural simplicity and ease of manufacture, of being able to restrain membrane defects when forming the layer, and of fewer inter-laminal interfaces improving optical characteristics, the single-layer type is preferable. Further, the material construction of the photosensitive layer for the laminated type may be the positive-charging kind in which the photosensitivity of the positive charge is large, or the negative-charging kind in which the photosensitivity of the negative charge is large, depending on the layer structure of the photosensitive conductor. Either may be utilized in the imaging method of the present invention.

The following explains an embodiment of the imaging method. of the present invention according to a reverse development system, taking as an example a case in which a positive-charging type photosensitive conductor 1 is utilized.

At first, in a main-charging stage in the main-charging unit 2, the surface of the photosensitive conductor 1 is charged at positive polarity. Therein, the main-charging voltage applied in the main-charging [stage will differ depending on the characteristics and developing conditions of the photosensitive conductor 1 and the toner, but the superficial electric potential on the photosensitive conductor 1 should be set so as to be +30 V to +1000 V.

As methods of applying the main-charging voltage, those that are conventional and publicly known are applicable: for example, the method in which the photosensitive conductor 1 is given a charge by running high voltage to effect corona discharge in a charging wire provided adjacent the surface of the photosensitive conductor 1, and the method of giving a charge to the photosensitive conductor 1 by running voltage in a conductive roller furnished in contact with or adjacent the photosensitive conductor 1 surface. The method based on corona discharge is in particular suitably utilized, since therefore the structure of the main-charging device is simple and can be inexpensively manufactured. In addition, furnishing a grid electrode between the charging wire and the photosensitive conductor, which therefore stabilizes the corona discharge, is further preferable.

Subsequently in the exposure stage, the photosensitive conductor 1 is exposed by the exposure unit 3 to form an electrostatic latent image in correspondence with an original document image on the photosensitive conductor 1 surface. In reverse-development systems, a laser beam or the like exposes the image portions of the original document; therefore the superficial electric potential on the photosensitive conductor 1 is low in the electrostatic latent image portions, and high in the non-image portions.

Following the exposure stage, the reverse-developing unit 4 supplies toner to the photosensitive conductor 1 surface. The present invention utilizes a reverse-development system; herein therefore, the toner, which has positive charge, under a positive-polarity developing bias voltage avoids the non-image portions on the photosensitive conductor 1 where the positive-polarity superficial electric potential is high, and is attracted to the image portions where the superficial electric potential is low, which are developed.

Subsequently, in the transfer unit 5, through the backside of a transfer medium 8 fed into contact with the surface of the photosensitive conductor 1, a negative-polarity transfer voltage is applied to the photosensitive conductor 1. Application of the negative-polarity transfer voltage electrostatically attracts and thereby transfers onto the face of the transfer medium 8 the toner with which the photosensitive conductor 1 surface has been developed. The transfer voltage is applied only during the passage of the transfer medium 8, but as previously noted, direct-applied portions—the portion immediately preceding the leading-end of the transfer medium 8, and the portion immediately following the trailing end—arise in which the transfer voltage is applied directly to the photosensitive conductor 1. Herein, a transfer voltage of minus several hundred volts to minus several thousand volts is applied, which makes the superficial electric potential of the direct-applied portions on the photosensitive conductor 1 opposite polarity to that of the main-charging voltage, and makes the superficial electric potential from around minus several hundred volts to −1 kV in the unexposed portions.

As methods of applying the transfer voltage, likewise as with the main-charging stage, the method based on corona discharge and the method utilizing a conductive roller can be used. The method based on corona discharge in particular is suitably utilized.

Proceeding from the transfer stage, in the separation stage the separation unit 6 applies a separation voltage to the transfer medium 8, and stripping the charge separates the transfer medium 8 from the photosensitive conductor 1. The separation voltage in the present invention is a separation shift-bias voltage of the same polarity as the main-charging voltage, superimposed on an AC voltage. Applying the separation shift-bias voltage, which is +1 kV or more, negates the superficial electric potential of the direct-applied portions, which has become around −1 kV in the transfer stage 5, and makes it possible to invert the polarity of the superficial electric potential.

A separation shift-bias voltage of +1 kV to +1.6 kV in particular will suppress the phenomenon of toner transferred onto the transfer medium 8 going back onto the photosensitive conductor 1. In addition, the separation shift-bias voltage does not have an impact on the application of the transfer voltage even in the vicinity of the transfer unit 5 and the separation unit 6. Toner transfer efficiency accordingly does not decline; and nor is the image density of halftones and halftone portions lowered.

Further, separation shift-bias voltages of 1 kV or less are insufficient to negate the superficial electric potential of the direct-applied portions, which is unsatisfactory since there will be instances in which density irregularities due to transfer ghosts appear.

As methods of applying separation voltage that includes separation shift-biasing potential, likewise as with the main-charging stage, the method based on corona discharge by means of a charging wire, and the method employing a conductive roller can be used. Utilizing the corona discharge-based method is especially suitable.

Further, given that the separation shift-bias voltage has not been superimposed on the separation voltage, if its peak value is set in the neighborhood of the voltage at which discharge commences, discharge of the separation shift-bias voltage will occur. This will effectively invert the polarity of the superficial electric potential on the photosensitive conductor 1. Specifically, although it will differ according to the use environment, the AC voltage can be set within the range of −3.5 kV to +4 kV.

Moreover, the discharge-initiating voltage will change depending on the gap between the photosensitive conductor 1 and the separation stage 6, as well as on the value of the volume-inherent resistance of the element that applies the voltage, such as the charge wire or conductive roller. In other words, the larger the gap or volume-inherent resistance value, the larger the discharge-initiating voltage will be; but specifically 4 kV to 8 kV is the general rule.

Following the separation stage, the charge-stripping unit 7 irradiates a charge-stripping beam onto the photosensitive conductor 1 surface. Therein, application of the separation shift-bias voltage makes the polarity of the superficial electric potential on the photosensitive conductor 1 positive—i.e. the polarity of the greater optical sensitivity of the positive-charging type photosensitive conductor 1. Charge-stripping irregularities therefore do not occur.

For the charge-stripping beam, a conventional publicly known light source, for example, an LED array or fluorescent tube can be employed. At a wavelength at which the photosensitive conductor 1 possesses sensitivity, the quantity of light should be sufficient to enable removal of charge remaining on the photosensitive conductor 1 surface.

In addition, to improve the efficiency with which toner is transferred in the transfer stage, a charge-stripping stage other than the previously described charge-stripping stage may be established before the transfer stage.

A cleaning unit 9 that executes a cleaning stage may be provided as a stage after the separation stage, for removing toner residual on the photosensitive conductor 1 surface or foreign matter such as paper dust adhered to the photosensitive conductor 1, without interrupting transfer in the transfer stage.

Moreover, the transfer medium 8 that is separated from the photosensitive conductor 1 in the separation stage is sent to fixing and other processing stages (not shown in the FIGURE).

The imaging method of the present invention in the foregoing example is a positive-charging type, but can likewise be embodied with a negative-charging type photosensitive conductor. Wherein a negative-charging type photosensitive conductor is employed, negative polarity main-charging voltage, negative polarity toner, positive polarity transfer voltage and negative polarity separation shift-bias voltage may be utilized in the foregoing imaging device.

Embodiment

The present invention will be explained by the following embodiment.

1. Photocopier Employed

A "Creage 630" experimentally remodeled machine (a Mita Industrial Mfg. photocopier) was utilized. The main-charging device charged the single-layer positive-charging type photosensitive conductor to a uniform +850 V, and image exposure was carried out with reflected optical density outputting a halftone of approximately 0.5. Then, applying a +650 V developing bias voltage, reverse development with a dual-component developing agent employing positive-charged toner was carried out. Subsequently, an evaluation image was obtained by transfer with a 6 kV transfer voltage to a transfer sheet, which underwent fixing.

Tests were conducted with the separation voltage 6 kV AC, and the separation shift-bias voltage altered between from 100 V to 2 kV.

Application of the main-charging voltage, the transfer voltage and the separation voltage was carried out based on corona discharge by a charging wire.

2. Evaluation (1) Method of measuring Image Density Irregularities

The image density of transfer ghost portions (thick portions of the image exhibited in bands in the lengthwise direction of the photosensitive drum) in the aforementioned evaluation image as well as the other, non-transfer-ghost portions was measured with a reflecting densitometer (Tokyo Denshoku Co., mfg.). A difference in image density between the two (ΔID) of 0.2 or more was taken to be poor. The results are shown in Table 1.

(2) Method of Evaluating Transfer Condition

The image density of the non-transfer-ghost portions in the aforementioned evaluation image was measured with the reflecting densitometer (Tokyo Denshoku Co., mfg.). An image density of 0.3 or more was taken to be good; 0.1 or more and less than 0.3, fair; and less than 0.1, poor. The results are shown in Table 1.

TABLE 1

| Separation Voltage | Separation Shift Bias | Transfer Conditions | | Image Density Irregularities | |
|---|---|---|---|---|---|
| (kV) | (V) | ID | Judgment | ΔID | Judgment |
| 6 | 100 | 0.50 | good | 0.22 | poor |
| 6 | 600 | 0.50 | good | 0.22 | poor |
| 6 | 1000 | 0.40 | good | 0.06 | good |
| 6 | 1300 | 0.40 | good | 0.06 | good |
| 6 | 1600 | 0.35 | good | 0.06 | good |
| 6 | 1800 | 0.25 | fair | 0.05 | good |
| 6 | 2000 | 0.15 | fair | 0.05 | good |

As thus in the foregoing, putting the separation shift-bias voltage in an imaging device that is used in the present invention to 1 kV or more prevents transfer ghosts, and obtains images with a satisfactory absence of image density irregularities. In particular, wherein the separation shift-bias voltage is made to be from 1 kV to 1.6 kV, the phenomenon in which toner transferred to the transfer medium 8 goes back onto the photosensitive conductor 1 is suppressed. And because the separation shift-bias voltage does not exert influence on the application of the transfer voltage in the vicinity of the transfer stage 5 and the separation stage 6, images in which the toner is satisfactorily transferred can be obtained.

Various details of the present invention may be changed without departing from its spirit nor its scope. Furthermore, the foregoing description of the embodiments according to the present invention is provided for illustration only, and not for the purpose of limiting the invention as defined by the appended claims and their equivalents.

What is claimed is:

1. An imaging method for forming images on a transfer medium in an imaging device provided with units surrounding a photosensitive conductor for executing at least a main-charging stage, an exposure stage, a reverse-developing stage, a transfer stage, a separation stage and a charge-stripping stage in that order, the imaging method comprising steps of:

the main-charging stage applying a main-charging voltage superficially to the photosensitive conductor; and the separation stage applying superficially to the photosensitive conductor through the transfer medium a separation voltage, the separation voltage being a separation shift-bias voltage superimposed on an AC voltage; wherein the separation shift-bias voltage is 1 kV or more, and of the same polarity as the main-charging voltage that is applied superficially to the photosensitive conductor in the main-charging stage.

2. An imaging method as set forth in claim 1, wherein the separation shift-bias voltage is 1 kV or more and 1.6 kV or less.

3. An imaging method as set forth in claim 1, wherein the main-charging stage, the transfer stage and the separation stage superficially charge the photosensitive conductor by corona discharge.

4. An imaging method as set forth in claim 1, wherein the photosensitive conductor is a single-layer organic photosensitive conductor.

5. An imaging device for carrying out imaging on a transfer medium, comprising a photosensitive conductor;

a main-charging device, an exposure device, a reverse-developing device, a transfer device, a separation device and a charge-stripping device disposed surrounding the photosensitive conductor for executing in that order a main-charging stage, an exposure stage, a reverse-developing stage, a transfer stage, a separation stage and a charge-stripping stage; wherein the main-charging device is for applying a main-charging voltage superficially to the photosensitive conductor; and the separation device is for applying superficially to the photosensitive conductor through the transfer medium a separation voltage, the separation voltage being a separation shift-bias voltage superimposed on an AC voltage, wherein the separation shift-bias voltage is 1 kV or more, and of the same polarity as the main-charging voltage the main-charging device applies superficially to the photosensitive conductor.

6. An imaging device as set forth in claim 5, wherein the separation shift-bias voltage is 1 kV or more and 1.6 kV or less.

7. An imaging device as set forth in claim 5, wherein the main-charging device, the transfer device and the separation device superficially charge the photosensitive conductor by corona discharge.

8. An imaging device as set forth in claim 5, wherein the photosensitive conductor is a single-layer organic photosensitive conductor.

9. An imaging device as set forth in claim 5, wherein the main-charging device charges the photosensitive conductor such that the superficial electric potential thereof is +300 V or more and +1000 V or less.

10. An imaging device as set forth in claim 9, wherein the reverse-developing device attracts superficially to the photosensitive conductor positive-charge holding toner to which positive-polarity developing bias voltage has been applied.

11. An imaging device as set forth in claim 10, wherein the transfer device applies negative-polarity transfer voltage through the back side of a transfer medium fed into superficially contact with the photosensitive conductor.

* * * * *